US005566486A

United States Patent [19]

Brinkley

[11] Patent Number: 5,566,486

[45] Date of Patent: Oct. 22, 1996

[54] FIREARM MONITORING DEVICE

[76] Inventor: Kenneth L. Brinkley, 3314 Thomas St., Erlanger, Ky. 41018

[21] Appl. No.: 376,047

[22] Filed: Jan. 19, 1995

[51] Int. Cl.[6] ..... F41A 9/62

[52] U.S. Cl. ..... 42/1.02; 42/1.03; 42/84

[58] Field of Search ..... 42/1.01, 1.02, 42/1.03, 1.05, 84

[56] References Cited

U.S. PATENT DOCUMENTS

| | | | |
|---|---|---|---|
| 1,150,756 | 8/1915 | Gocke | 42/1.03 |
| 1,324,098 | 12/1919 | Arter | 42/1.03 |
| 1,479,138 | 1/1924 | Hazelton | 42/1.03 |
| 2,152,947 | 4/1939 | Blomerius | 42/1.03 |
| 4,001,961 | 1/1977 | Johnson et al. | 42/1.03 |
| 4,829,692 | 5/1989 | Guild | 42/1.01 |
| 5,005,307 | 4/1991 | Horne et al. | 42/1.02 |
| 5,033,217 | 7/1991 | Brennan | 42/1.01 |
| 5,291,680 | 3/1994 | Schabdach et al. | 42/1.01 |
| 5,406,730 | 4/1995 | Sayre . | |

FOREIGN PATENT DOCUMENTS

| | | | |
|---|---|---|---|
| 554905 | 8/1993 | European Pat. Off. | 42/1.01 |
| 137645 | 1/1920 | United Kingdom | 42/1.03 |
| 2182424 | 5/1987 | United Kingdom | 42/1.02 |

*Primary Examiner*—Harold J. Tudor
*Assistant Examiner*—Theresa M. Wesson
*Attorney, Agent, or Firm*—Frost & Jacobs

[57] ABSTRACT

A firearm monitoring device has first means which generate a first signal in response to each recoil of the firearm and second means which receive the first signal and generate a signal which is indicative of the number of first signals received by the second means. More particularly, the firearm monitoring device has an inertia switch, which is mounted to the firearm, which generates a signal in response to recoil of the firearm. The signal is counted by a microcontroller which generates an output signal for delivery to a display or data collection device. The output signal can indicate the number of rounds left to be discharged, based on an initial number preset by the user, and can indicate the total number of rounds discharged by the firearm during its life. Additional controls are provided which allow the user to temporarily decrease the beginning number for the countdown.

21 Claims, 3 Drawing Sheets

FIREARM MONITORING DEVICE

TECHNICAL FIELD

The present invention relates generally to a device for collecting data about the usage of a firearm, and monitoring the number of times a firearm is discharged, and is particularly directed to a device which counts the number of times that a firearm is discharged and delivers information concerning the number of rounds left to discharge and the total number of rounds discharged through the firearm. The invention will be specifically disclosed in connection with a device which counts each recoil of the firearm and then displays the number of rounds remaining, or the total number of rounds discharged.

BACKGROUND OF THE INVENTION

An accurate count of the number of rounds remaining in a firearm is of great importance to the user. With firearms of any type, particularly handguns, it is frequently difficult, if not impossible, to determine accurately the number of rounds remaining in the firearm. This is particularly true when the firearm is being used in an urgent situation, such as those which occur in law enforcement or combat. Usually in such urgent situations, the user is unable to keep track of the number of rounds discharged, and has no time to manually check the status of the firearm.

This difficulty exists in all types of firearms, including automatic and semi-automatic firearms. The problem is particularly acute with automatic firearms where it can be impossible to count at all the number of rounds due to the discharge rate.

Additionally, the total number of rounds fired through a firearm is also of great importance in order to monitor the service life of the firearm so that proper maintenance can be provided. This is true for not only hand held firearms, but also for large or permanently mounted firearms such as that used by the military. With such information, preventative maintenance can be performed before the firearm fails.

To date there have been various attempts to provide monitoring systems which can provide information regarding the number of rounds remaining. For example, U.S. Pat. No. 5,142,805 to Horne et al discloses a handgun in which a microprocessor counts the number of times the gun's slide mechanically engages a switch. Because this device requires a slide, the gun must be configured to interface mechanically with the monitoring device. This requires retooling of the slide, which, in addition to the expense, limits the ability to use this device as an after market application. For each different type of slide, different interfaces must be provided. Such a device is not readily adaptable for each type of handgun, nor can a single design of such a device possibly fit substantially all types of handguns which are available. For example, such a device cannot be easily adapted to revolvers, which do not have slides. Furthermore, automatic and semi-automatic rifles have internal bolts and carriers, lacking the slide required for this device. There are also substantial durability concerns arising out of the mechanical contact between the slide and the switch.

U.S. Pat. No. 4,146,987 discloses a device for large caliber firearms which includes a weight eccentrically mounted at the end of a long shaft. The weight causes the shaft to rotate in response to the firing of the firearm, actuating a mechanical ratchet. Such a device is not suited for small firearms due to its configuration as well as the extra mass present in the shaft and weight. In addition to the durability problems inherent in such a mechanical counter, this device would probably have difficulty in keeping up with high cycle rates, such as 300 rounds per minute and higher.

There is a need in the art for an accurate monitoring device for counting the number of times a firearm is discharged, particularly which can be easily fitted to all types of firearms, pistols, rifles, shotguns, and which will operate with any type of action, such as single action, double action, semi-automatic and automatic.

SUMMARY OF THE INVENTION

It is an object of this invention to obviate the above-described problems in shortcomings of the prior art heretofore available.

It is another object of the present invention to provide a firearm monitoring device which is responsive to the recoil of the firearm.

It is yet another object of the present invention to provide a firearm monitoring device which can provide a count of the total number of rounds discharged through the firearm.

It is another object of the present invention to provide a firearm monitoring device which can provide an output as a visually or audibly perceptible display or as a feed to a data collection system such as a computer.

It is still a further object of the present invention to provide a firearm monitoring system which can be used on a variety of different models of firearms with no or minor adaptations.

It is yet a further object of the present invention to provide a firearm monitoring system which includes a display which can be easily viewed, especially at night or in low light situations with minimal loss of night vision.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a firearm monitoring device having first means which generate a first signal in response to each recoil of the firearm and second means which receive the first signal and generate a signal which is indicative of the number of first signals received by the second means. More particularly, a firearm monitoring device having an inertia switch, which is mounted to the firearm, generates a signal in response to recoil of the firearm. The signal is counted by a microcontroller which generates an output signal for delivery to a display or data collection device. The output signal can indicate the number of rounds left to be discharged, based on an initial number preset by the user, and can indicate the total number of rounds discharged by the firearm during its life. Additional controls are provided which allow the user to temporarily decrease the beginning number for the countdown.

Still other objects of the present invention will become apparent to those skilled in this an from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
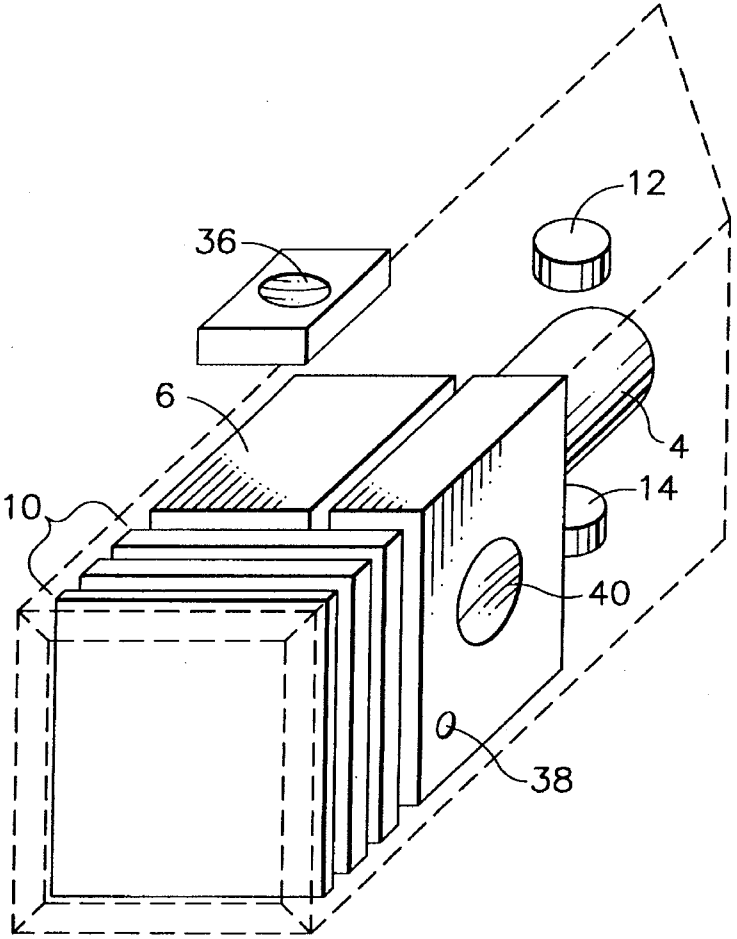
FIG. 1 is a diagrammatic, partially exploded perspective view of a firearm monitoring device according to the present invention with a housing shown in dashed lines.

Referring now to the drawings in detail, wherein like numerals indicate the same elements throughout the views, FIG. 1 shows diagrammatic representations of the various components of a firearm monitoring device constructed in accordance with the present invention, with a housing shown in phantom lines. Firearm monitoring device 2 includes inertia switch assembly 4, microcontroller 6, reset switch 36 (shown above firearm monitoring device 2 for clarity), count adjustment switch 38, back light on-off switch 40, and display 10. Inertia switch assembly 4 is configured to generate an electrical signal, such as by completing an electrical circuit, in response to each time the firearm recoils, which occurs when the firearm is discharged. Inertia switch assembly 4 is electrically connected to microcontroller 6, which, as described in greater detail below, is adapted to count each such signal. Microcontroller 6 generates an electrical signal which drives display 10. As described below, back lighting battery 12 and microcontroller battery 14 provide power to firearm monitoring device 2.

Figure 2:
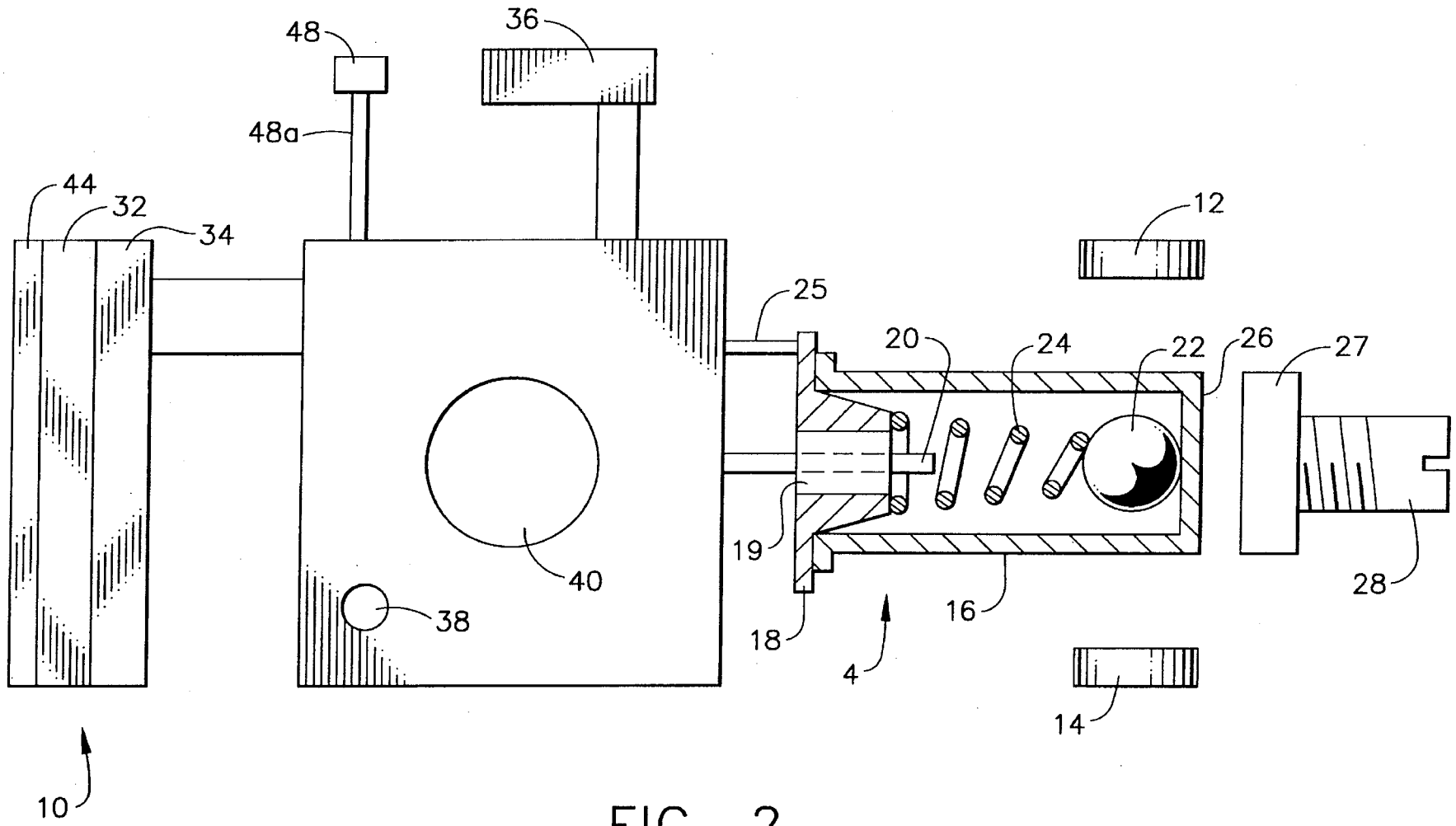
FIG. 2 is a fragmentary, diagrammatic side view of the firearm monitoring device of FIG. 1.

Referring to FIG. 2, inertia switch assembly 4, shown in cross-section, includes housing 16, end 18, center contact 20, ball 22 and spring 24. Center contact 20 is electrically isolated from end 18 by non-conductive material 19. Housing 16 acts as a guide within which ball 22 and spring 24 are disposed. Housing 16, which defines the path of movement of ball 22, is generally aligned with the bore of the firearm to which firearm monitoring device 2 is attached. Alternatively, housing 16 can be formed integrally with the housing (not shown in FIG. 2) or can be separate as illustrated in FIG. 2.

When the firearm is discharged, the firearm experiences recoil. Ball 22, whose mass is substantially smaller than that of the firearm, reacts to the recoil and contacts center contact 20. Ball 22, which is metal in the preferred embodiment, completes an electrical circuit from center contact 20, through ball 22, spring 24 and/or housing 16, end 18 to post 25. Center contact 20 and post 25 are electrically connected to microcontroller 6.

Ball 22 and spring 24 are selected based on the physical characteristics of the firearm and the rounds being discharged so as to close the electrical circuit in response to the recoil of the firearm upon discharge, but preferably not in response to other impacts which the firearm might experience. Preferably, this electrical circuit is closed only once for one discharge of the fire arm, with ball 22 returning to a position adjacent the distal end 26 of housing 16. However, for production purposes, it is anticipated that a given ball and spring combination will be used for a range of firearms and calibers. Given such a range of firearms and calibers that a given ball and spring combination may have to accommodate, the microprocessor can be programmed to ignore multiple closures occurring within a predetermined period of time which result from any "bounce" of ball 22. Additionally or alternatively, magnet 27 (shown only in FIG. 2) may be disposed adjacent distal end 26, creating an additional return force on ball 22. As should be apparent, in the event that magnet 27 is used, ball 22 must be magnetic and housing 26 non-magnetic. Adjustment screw 28 can be screwed in or out to adjust the distance between ball 22 and magnet 27. Magnet 27 and adjustment screw 28 may be carried directly by housing for firearm monitoring device 2 or by housing 16. To increase the range of firearms and calibers which a given ball and spring combination can accommodate, different strength magnets may be made available and provisions made for magnet 27 to be removed from the outside of the housing of firearm monitoring device 2.

In order to determine the ball and spring set, the amount of recoil of a particular firearm should be determined. This can be done using various empirical methods such as mounting an accelerometer to the firearm, or measuring the displacement and time lapse using high speed photography. In constructing the preferred embodiment, a 45 caliber ACP model 1911 was photographed, showing a travel of 38 mm and a complete lapsed time (displacement and return) of 0.10 seconds. Using this information, a ball and spring combination was selected. The cycle rate of the firearm should also be considered in order to avoid bounce of the ball which would generate multiple closures or resonance of the ball which would not generate the necessary closure.

By aligning the path of movement of the ball with the bore of the firearm, the potential for false counts due to impacts to the firearm is reduced. For example to duplicate the forces which are present in a handgun during recoil, the handgun would have to receive an impact substantially in line with the bore. Any impacts not so in line would have to generate a component in line with the path of movement of the ball sufficient to cause the ball to strike the actuator.

Inertia switch assembly 4 functions as a means for generating a signal in response to substantially each recoil of a firearm. As will be appreciated, there are numerous other equivalent structures which can provide the same functionality. For example, ball 22 could actuate an actuator, which could be a plunger or a device which is merely responsive to the proximal presence of the ball rather than displacement of a plunger. Various other arrangements of the ball and spring design could also be used. For example, the direction of the assembly could be reversed, or the spring located on the opposite side of the ball (with the appropriate change to the location of contact 20). Instead of a ball and spring arrangement, an accelerometer could be used, with the appropriate circuitry to generate the necessary signal in response each recoil of the fire arm.

Further, as will be readily appreciated, all or part of inertia switch assembly 4, or any of its equivalents, must be mounted so as to be responsive to the recoil of the firearm. The other components of firearm monitoring device 2 can be mounted remote from the firearm, which may be advantageous for large caliber or permanently mounted firearms. For handguns, however, the display means needs to be in a convenient location to be observed during use of the handgun.

Microcontroller 6 (not seen in FIG. 2) is electrically connected to inertia switch assembly 4, through center contact 20 and post 25, and as mentioned above, microcontroller 6 receives the signal from inertia switch assembly 4. Microcontroller 6 is a programmable microcontroller, which has been configured to count the number of signals, or circuit closures it receives from inertia switch assembly 4. In the preferred embodiment, microcontroller 6 is a Sanyo LC5732N. Microcontroller 6 generates an output signal which is indicative of the number of signals it has received from inertia switch assembly 4. This output signal drives display 10, which is connected through flex connector 30. Display 10 can be any type of visually perceptible display, such as a graphical display or a numeric display. In the preferred embodiment, display 10 includes nine segment, positive LCD 32 and back light 34, giving a visual indication indicative of the count. Back light 34 is preferably red so as to minimize the loss of night vision when reading LCD 32. A nine segment LCD was used to minimize size, but larger displays can also be used. Although the preferred embodiment uses a visual display, which continuously displays the count, as used herein, display is not limited to visually perceptible displays, but can include audio displays, such as tones or even spoken numbers, alone or in combination with a visual display. Additionally, the output of microcontroller 6 may be directed to a data collection device, such as a computer, through use of port 48, which is connected to microcontroller 6 through connector 48*a*. This feature will be particularly useful with large caliber or permanently mounted firearms.

To operate firearm monitoring device 2, microcontroller 6 is connected to reset switch 36, count adjustment switch 38 and back light on-off switch 40. In operation, the user sets the total number of rounds available by depressing count adjustment switch 38. To prevent accidental resetting, count adjustment switch 38 is preferably configured to require a thin, blunt object, such as a ballpoint pen tip, to depress. Starting from this maximum number, microcontroller 6 will decrease the number on the display each time it receives a signal from inertia switch assembly 4. Once the display reaches zero, and the firearm has been reloaded, reset switch 36 is depressed, and the count is reset to the maximum. By depressing reset switch 36 and holding it, the display will count down from the maximum number until reset switch 36 is released. This allows the use of a smaller number of rounds without having to reset the maximum number.

Back light on-off switch 40 allows back light 34 to be turned on and off, in order to conserve back lighting battery 12. It should be noted that, due to the current drain, back lighting battery 12 will not last as long as microcontroller battery 14. For this reason, back lighting battery 12 is easily accessible through the firearm monitoring device 2 housing (see FIG. 3). As will be understood, microcontroller battery 14 should also be easily accessible, but it is not anticipated that microcontroller battery 14 will require replacement as frequently as will back lighting battery 12. Batteries 12 and 14 can be located in alternative locations, such as in the grip of a hand gun. A primary consideration in battery location is the size of available batteries.

Microcontroller 6 also maintains a count of the total number of signals it receives from inertia switch assembly 4. Microcontroller 6 is configured to retain this total number in memory even in the event of power loss. As mentioned above, this may be used for maintenance of the firearm. This feature may be provided alone or with the above described ability to count the number of rounds left. Preferably, the total count cannot be reset. Microcontroller 6 could also be configured to provide an additional interval count which could be reset, for example, after each performance of routine maintenance.

In the preferred embodiment, since display 10 is only a nine segment display, the total count beyond 19 cannot be done directly. Thus, in the preferred embodiment, an external display (not shown), preferably capable of displaying at least 5 full digits, is connected to microcontroller 6 through an electrical port. For example, as shown in FIG. 2, port 48 is diagrammatically indicated. Microcontroller 6 generates the signal required for the external display to display the total count. Such an external display could be made available, for example, to gun stores or manufacturers which could provide access to the total as an additional service. Of course, if a larger display is used on firearm monitoring device 2, an external display would not necessarily be required. There are numerous other ways to display the total count information, such as by sequential display on display 10 of the individual numerals of the total number.

Also, as mentioned above, microcontroller 6 could be connected to a data collection device or computer, particularly for large caliber or permanent installations, such as military applications. This would allow better management of maintenance and tracking of usage. In such case, microcontroller 6 would be configured to deliver data through port 48, such as in a generic numeric code format. Additionally, although a wide range of microcontroller can be used, the particular microcontroller selected for the preferred embodiment has excess capacity for additional functions which can be added if desired. For example, the microcontroller selected is capable, with the appropriate additional externals, of displaying compass directions.

Figure 3:
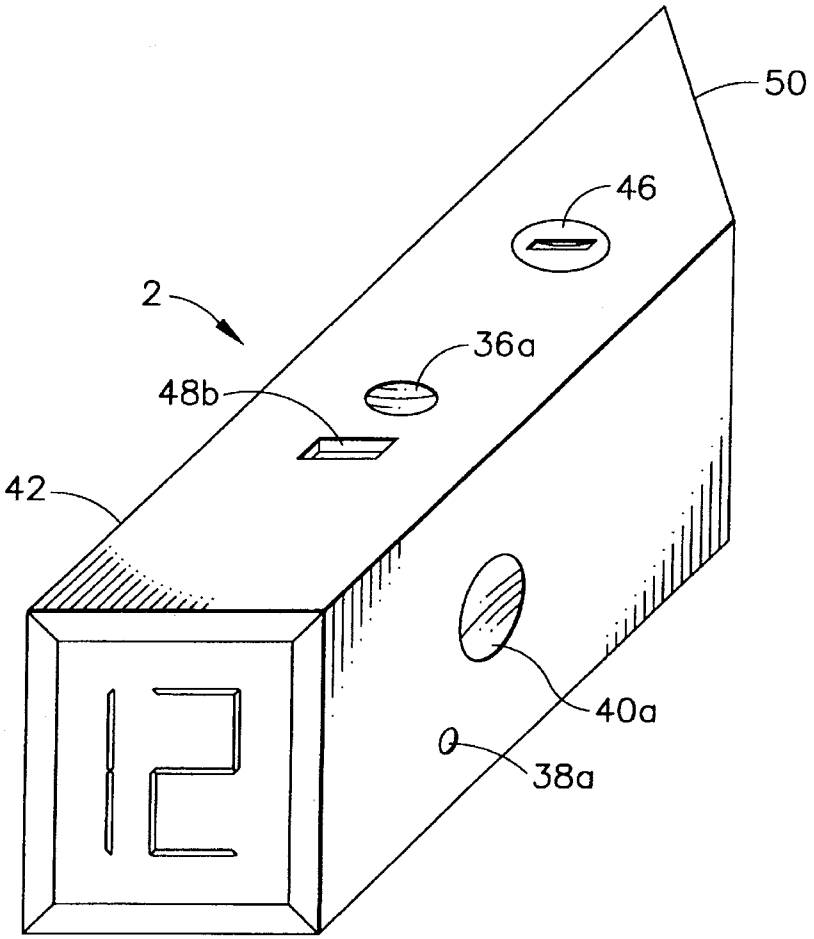
FIG. 3 is a diagrammatic perspective view of the firearm monitoring device of FIG. 1 with a housing.

Referring to FIG. 3, firearm monitoring device 2 is shown disposed within housing 42. Housing 42 is sealed to protect firearm monitoring device 2 from the environment, particularly from solvents which are frequency used for cleaning. For this reason, reset switch 36, count adjustment switch 38 and back light on-off switch 40 are tactile switches which underlie thin portions 36*a*, 38*a* and 40*a*, respectively, of housing 42. LCD 32 is protected by lens 44 (FIG. 2) which is sealed to housing 42. Back lighting battery access cover 46 is also sealed, as is adjustment screw 26. Opening 48*b*, which provides access to electrical port 7, is also sealed. Housing 42 is designed to be attached to the hand grip of a handgun. When used with a handgun, end 50 of housing 42 is angled to permit easier holstering.

Figure 4:
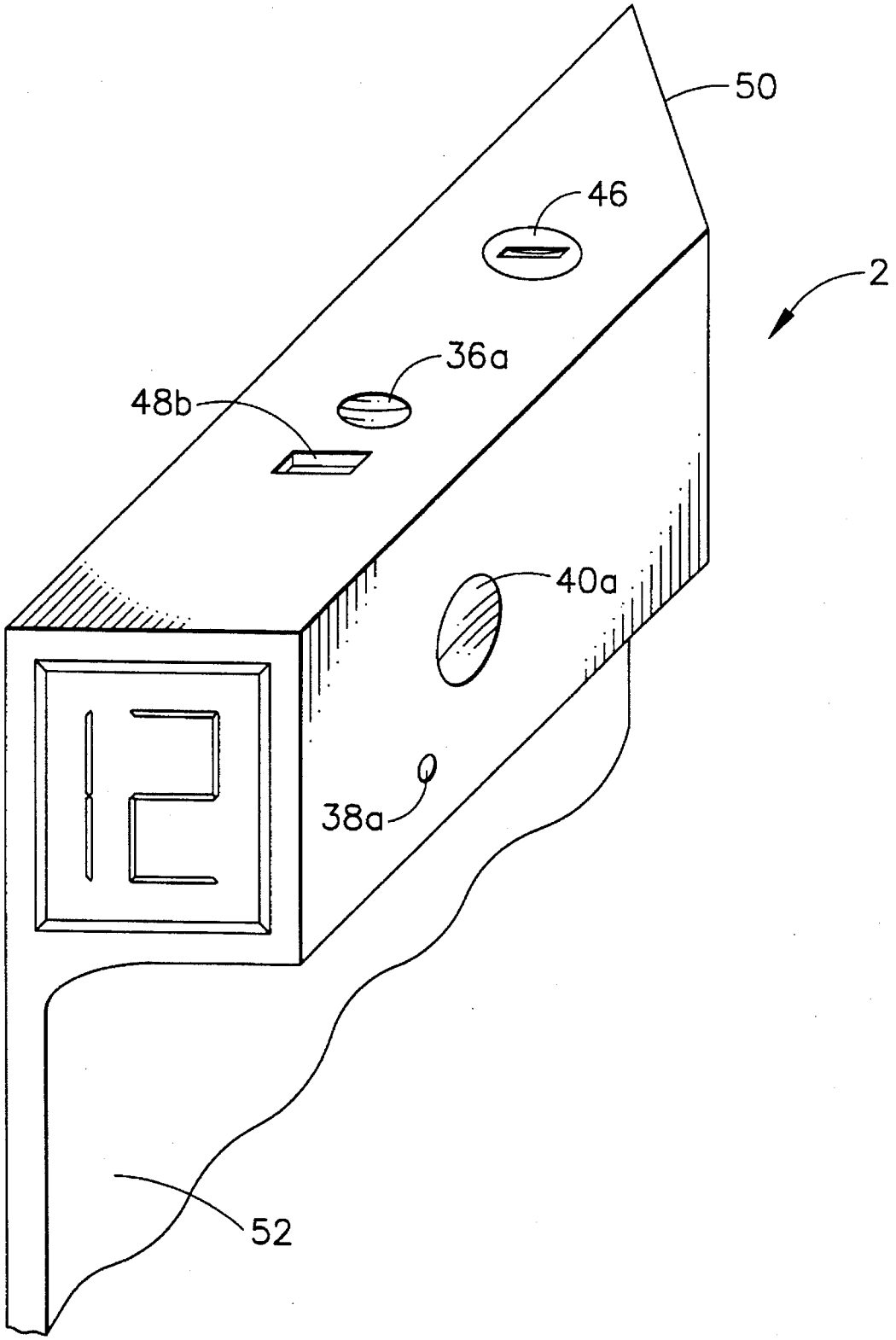
FIG. 4 is a diagrammatic perspective view of an embodiment of the present invention incorporating an integral hand grip.

Other housing may of course be used, the design of which depends on the specific application. For example, as shown in FIG. 4, handgrip 52 may comprise the housing for firearm monitoring device 2. Handgrip 52 may be a universal handgrip, or specific to a particular handgun.

Additionally, in order to discourage tampering with the device, particularly the total count, some type of indicator can be used to indicate whether the housing has been breached. For example, a dye which is responsive to exposure to air could be applied prior to sealing within the housing.

As will be appreciated, when firearm monitoring device 2 is used with a handgun or rifle, size and location are of prime importance. Firearm monitoring device 2 can be mourned at any appropriate location on the firearm, preferably so long as display 10 is easily visible. For larger firearms, size and location may become less important. As will be appreciated, microcontroller 6 and display 10 do not have to be mounted to the firearm. The present invention can also be adapted for use on devices other than firearms to count cycle rates, so long as there is sufficient acceleration/movement of the device to cause the invention to generate a signal in response to the acceleration/movement. For example, the present invention could be used to count the closing of a door, or other repetitive movement of almost anything.

In summary, numerous benefits have been described which result from employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A firearm monitoring device for attaching to a firearm, said firearm having a firing end and a grip end, and said firearm being susceptible to recoil when discharged, comprising:

a) first means for creating a first signal in response to substantially each recoil of said firearm; and b) second means for receiving each said first signal and generating a second signal indicative of the number of said first electrical signals received by said second means;

wherein said first means comprise an inertia switch comprising a movable mass; and wherein said mass is resiliently biased toward the firing end of the firearm.

2. The device of claim 1 comprising display means for receiving said second signal and generating a display in response to said second signal.

3. The device of claim 2 wherein said display is an audible display.

4. The device of claim 2, wherein said display is positioned such that it is visible to a user of the firearm while firing in a direction away from the user.

5. The device of claim 1, the movement of said mass being generally confined to movement along a straight line.

6. The device of claim 5 wherein said firearm includes a bore through which a round of ammunition is discharged, said straight line being generally parallel to said bore.

7. The device of claim 1 wherein said second means include means for counting down by one in response to each said first signal beginning from a predetermined number.

8. The device of claim 7 wherein said second means include means for changing said predetermined number.

9. The device of claim 1 wherein said second means include means for maintaining a total count of the number of said first signals received from said first means.

10. The device of claim 1 wherein said second means comprise a microcontroller adapted to count each said first signal received by said microcontroller.

11. The device of claim 10 wherein said second means further comprise a communication port, wherein information may be stored in and accessed from the microcontroller via the communication port.

12. The device of claim 1 wherein the removable mass is detached and free-floating.

13. The device of claim 1, wherein the inertia switch comprises a substantially cylindrical housing and a spring.

14. A firearm in combination with a monitoring device, said firearm having a firing end and a grip end, and said firearm being susceptible to recoil when discharged, said monitoring device comprising:

a) first means for creating a first signal in response to substantially each recoil of said firearm; and b) second means for receiving each said first signal and generating a second signal indicative of the number of said first electrical signals received by said second means;

wherein said first means comprise an inertia switch comprising a movable mass; and wherein said mass is resiliently biased toward the firing end of the firearm.

15. The combination of claim 14 wherein said firearm includes a bore through which a round of ammunition is discharged, and the movement of said mass being generally confined to movement along a straight line generally parallel to said bore.

16. The combination of claim 14 wherein said second means include means for counting down by one in response to each said first signal beginning from a predetermined number.

17. The combination of claim 16 wherein said second means include means for changing said predetermined number.

18. The combination of claim 14 wherein said second means include means for maintaining a total count of the number of said first signals received from said first means.

19. The combination of claim 14 wherein said second means comprise a microcontroller adapted to count each said first signal received by said microcontroller.

20. The combination of claim 19 wherein said second means further comprise a communication port, wherein information may be stored in and accessed from the microcontroller via the communication port.

21. The device of claim 14 wherein the movable mass is detached and flee-floating.

* * * * *